US007802586B1

(12) United States Patent
Funari et al.

(10) Patent No.: US 7,802,586 B1
(45) Date of Patent: Sep. 28, 2010

(54) VACUUM BREAKER

(75) Inventors: Michael A. Funari, Apex, NC (US); J. Timothy O'Connor, Whispering Pines, NC (US)

(73) Assignee: Zurn Industries, LLC, Erie, PA (US)

( * ) Notice: Subject to any disclaimer, the term of this patent is extended or adjusted under 35 U.S.C. 154(b) by 330 days.

(21) Appl. No.: 11/522,101

(22) Filed: Sep. 15, 2006

Related U.S. Application Data

(60) Provisional application No. 60/717,405, filed on Sep. 15, 2005.

(51) Int. Cl.
*E03C 1/10* (2006.01)

(52) U.S. Cl. ..... 137/217

(58) Field of Classification Search ..... 137/217, 137/526, 853; 251/34, 37, 40
See application file for complete search history.

(56) References Cited

U.S. PATENT DOCUMENTS 2,371,449 A * 3/1945 Langdon ..... 137/852
3,334,646 A 8/1967 Billeter et al.
3,381,654 A * 5/1968 Hupp et al. ..... 116/237
3,986,538 A * 10/1976 Sather ..... 141/332
5,271,600 A 12/1993 Saadi et al.
5,564,460 A 10/1996 Gronwick et al.
5,937,890 A * 8/1999 Marandi ..... 137/271
6,119,713 A 9/2000 Pino
6,189,554 B1 2/2001 Pino
6,299,130 B1 * 10/2001 Yew et al. ..... 251/129.15
6,554,018 B1 4/2003 Pino
2004/0107005 A1 * 6/2004 Chaussy et al. ..... 623/23.68

* cited by examiner

*Primary Examiner*—John Rivell
*Assistant Examiner*—Craig M Schneider
(74) *Attorney, Agent, or Firm*—The Webb Law Firm

(57) ABSTRACT

A vacuum breaker that includes a substantially cylindrical tubular body having a first end and a second end, wherein the first end has a rim extending away from the body and a ledge extending axially away from the rim thus defining an L-shaped profile. A retainer bead extends axially away from an end of the ledge toward the vacuum breaker body, wherein the retainer bead is adapted to provide a friction fit for releasably attaching a flow control insert to the first end of the body of the vacuum breaker. The second end of the body includes a plurality of lip seals, wherein each lip seal defines a slit with a molded hinged member at an end thereof. The hinged member is preferably in the shape of a hole to prevent tearing and maintain the correct slit length.

17 Claims, 8 Drawing Sheets

VACUUM BREAKER

CROSS REFERENCE TO RELATED APPLICATION

This application claims the benefit of U.S. Provisional Application No. 60/717,405 entitled "Vacuum Breaker," filed on Sep. 15, 2005, which is hereby incorporated by reference.

BACKGROUND OF THE INVENTION

1. Field of the Invention

The present invention relates, in general, to vacuum breakers and, more specifically, to vacuum breakers for use in a flush valve assembly.

2. Description of Related Art

Vacuum breakers are currently used in water supply systems where there is danger of back-syphonage occurring from contaminated plumbing fixtures such as urinals and toilets to enter back into the potable water supply feeding a flush valve. For example, U.S. Pat. No. 3,334,646 to Billeter et al. discloses a vacuum breaker having a substantially cylindrical elastomeric body with a plurality of cylindrically-spaced ends positioned about a lower portion of the body. An upper portion of the body includes a recess to receive a tapered baffle or insert member having a plurality of water ports.

U.S. Pat. No. 5,564,460 to Gronwick et al. also discloses a vacuum breaker that includes a substantially cylindrical elastomeric body with a plurality of circumferentially-spaced projections positioned about a lower portion of the body. The body further includes a tapered inner surface positioned below the projections. A baffle is received within a recess defined at an upper portion of the body.

Finally, U.S. Pat. No. 6,189,554 to Pino discloses a vacuum breaker for a flush valve that includes a flexible sleeve having a plurality of projections circumferentially spaced about the outer surface of the body and a tapered lip seal positioned below the projections. A baffle is received by a recess defined in the body at an upper portion thereof. U.S. Pat. Nos. 3,334,646; 5,564,460 and 6,189,554 are hereby incorporated by reference.

FIG. 1 illustrates one type of prior art vacuum breaker assembly 10, similar to those disclosed in the above-referenced patents. The prior art vacuum breaker assembly 10 includes an outlet tube 12 having circumferentially-spaced air openings 14. A coupling nut 16 is used to attach the vacuum breaker assembly 10 to a lower section 18 of a flush valve 20 (partially shown). A typical flush valve is described in U.S. Pat. No. 5,271,600, assigned to Zurn Industries, Inc., which is hereby incorporated by reference. A downstream end of the outlet tube 12 is adapted to connect to an inlet side of a water closet or urinal (not shown).

Referring to FIGS. 1 and 2, the prior art vacuum breaker assembly 10 includes a prior art vacuum breaker 22 having a substantially cylindrical body 23 positioned inside of the outlet tube 12. The vacuum breaker 22 having a first end 24 and a second end 26 is suitably formed of a rubber-like or flexible elastomeric material. The first end 24 of the vacuum breaker 22 includes a flange 28 having a double-sided recess 30 for receiving an outwardly extending flange 32 of a cone-shaped flow control insert 34 or baffle arrangement. The insert 34 includes a plurality of openings for the passage of water. A paper gasket seal 38 is typically seated on top of the flange 28 to seal the first end 24 of the vacuum breaker 22 to a lower section 18 of the flush valve 20. A shield 40 attached to a lower end of the coupling nut 16 is spaced from air openings 14 so that the air openings 14 may perform their intended function of admitting air at atmospheric pressure into an interior of vacuum breaker assembly 10 to prevent back-syphonage.

FIG. 2, which shows a bottom view of the prior art vacuum breaker 22, includes a plurality of lip seals 42, 44 and 46 at the second end 26 of the body 23 of the vacuum breaker 22. Each of these lip seals 42, 44 and 46 has circumferentially-spaced projections or ribs 48 which are slightly thicker than other portions of the lip seals, with the ribs 48 defining between them a slit 50 which can open to permit the passage of water through the vacuum breaker assembly 10.

The prior art vacuum breaker 22 performs in the following manner. In normal use, the flow of water into the vacuum breaker assembly 10 will pass through the cone-shaped flow control insert 34, with water pressure forcing the lip seals 42, 44 and 46 to spread apart, permitting water to flow through slits 50 to a plumbing fixture connected at an outlet end of the vacuum breaker assembly 10 (not shown). In the event that there is a negative pressure at a water supply, air will flow in through air openings 14. This causes the walls of vacuum breaker 22 to collapse, preventing the passage of water from the downstream plumbing fixture into the potable water supply. The purpose of the vacuum breaker 22 is to expand during every flush to prevent weeping (i.e., water leakage) and contract after the flush is done to allow pressure equalization. In operation, vacuum breaker 22 will rapidly expand outwardly against the interior wall of outlet tube 12 to seal air openings 14 and prevent water leakage.

The prior art vacuum breakers discussed above suffer from various drawbacks. First, each of the designs discussed above requires a double-sided recess 30 adapted to receive an insert 34 or baffle arrangement, thus making installation of the insert 34 or baffle arrangement difficult to install. Furthermore, the typical cone-shaped insert 34 or baffle arrangement used in prior art vacuum breakers creates a relatively high pressure drop. Finally, the plurality of projections or ribs 48 defining slits 50 therein of the prior art vacuum breaker 22 are often prone to tearing or other similar durability problems when receiving water at high pressure.

Accordingly, a need exists for a vacuum breaker that allows for simple installation of a flow control insert or baffle arrangement. A further need exists for a vacuum breaker with high durability that includes a flow control insert or baffle arrangement that leads to a reduced pressure drop.

SUMMARY OF THE INVENTION

The present invention is directed to a vacuum breaker that includes a substantially cylindrical tubular body having a first end and a second end, wherein the first end has a rim extending away from the body and a ledge extending axially away from the rim thus defining an L-shaped profile. A retainer bead extends axially away from an end of the ledge toward the vacuum breaker body, wherein the retainer bead is adapted to provide a friction fit for releasably attaching a flow control insert to the first end of the body of the vacuum breaker. The second end of the body includes a plurality of lip seals, wherein each lip seal defines a slit with a hinged member at an end thereof. The hinged member is preferably in the shape of a hole to prevent tearing and maintain the slit length.

The flow control insert may have a substantially flat, disc-shaped body defining a plurality of circumferentially-spaced openings therein. The plurality of openings in the flow control insert may be either circular, pie-shaped or any combination thereof for allowing the water to flow therethrough. Furthermore, the flow control insert is thicker and larger in diameter than the typical prior art inserts in order to prevent buckling.

DETAILED DESCRIPTION OF THE INVENTION

Figure 1:
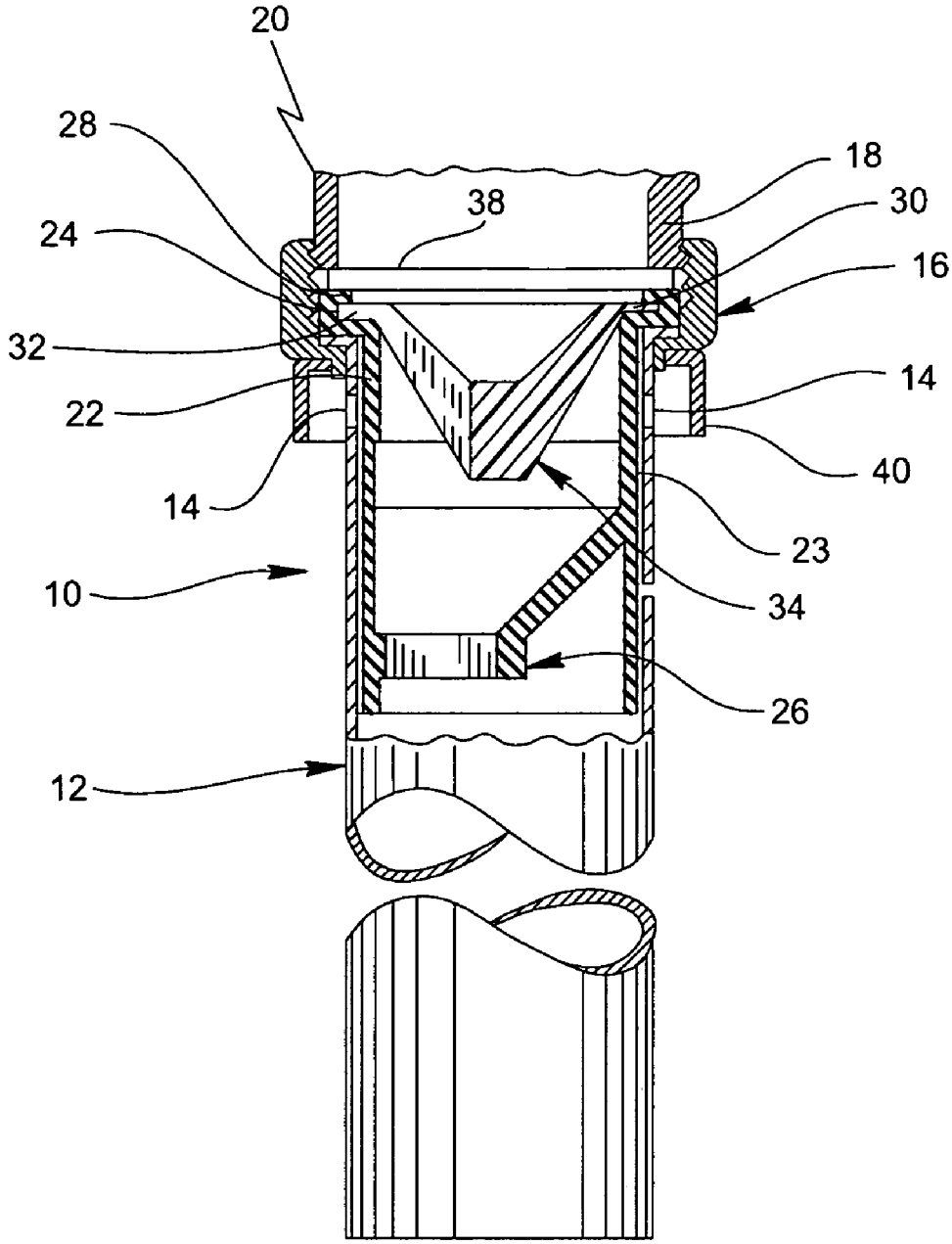
Fig. 1 (PRIOR ART)
FIG. 1 is a cross-sectional view of a prior art vacuum breaker assembly.
Figure 2:
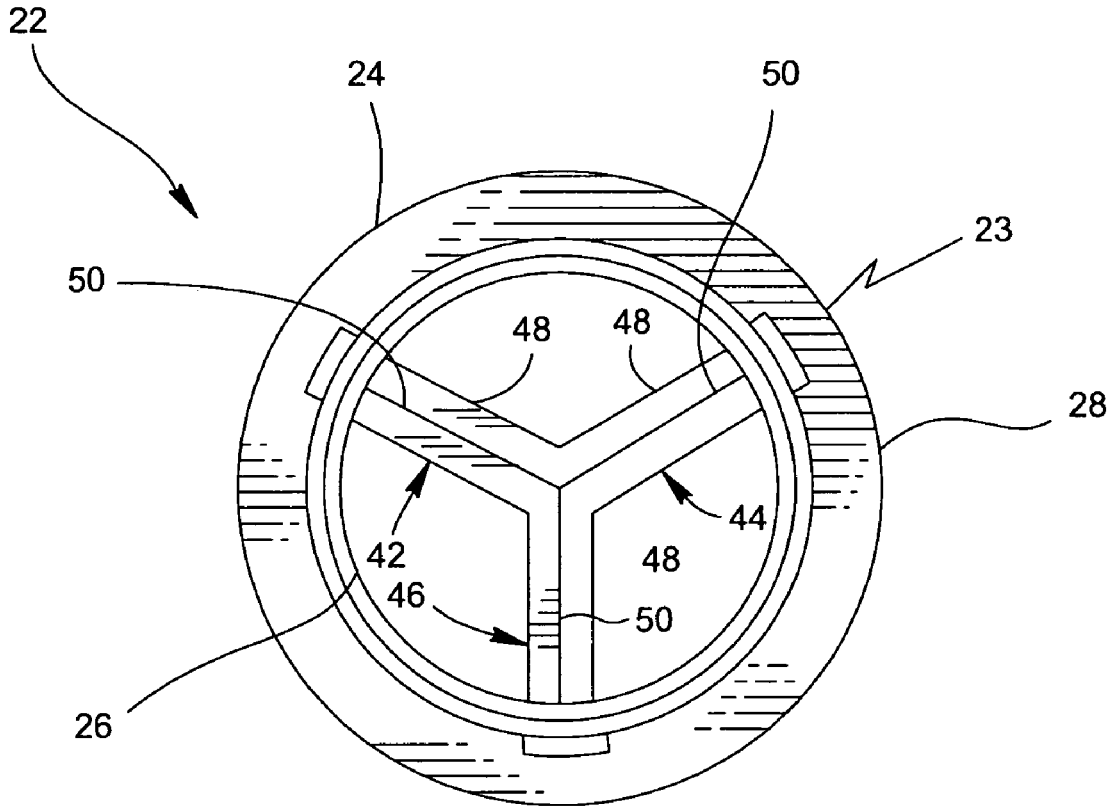
Fig. 2 ( PRIOR ART )
FIG. 2 is a bottom plan view of the prior art vacuum breaker assembly shown in FIG. 1.
Figure 3:
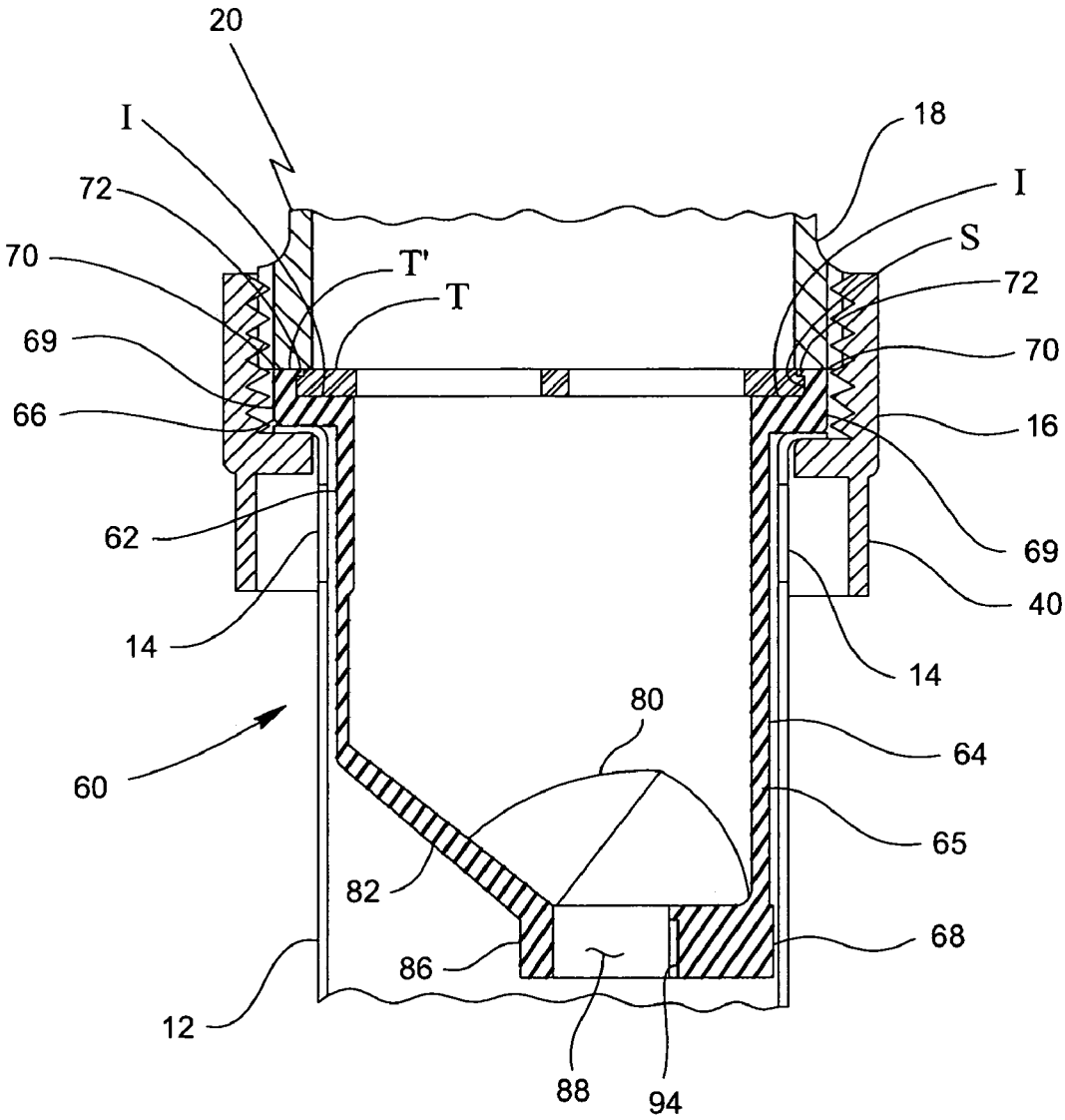
FIG. 3 is a cross-sectional view of a vacuum breaker assembly made in accordance with the present invention.

Referring to FIG. 3, the present invention provides for a vacuum breaker assembly 60 that is similar to the prior art vacuum breaker assembly 10, except for the differences noted below. Like reference numerals are used for like parts. The vacuum breaker assembly 60 includes an outlet tube 12 having circumferentially-spaced air openings 14, a vacuum breaker 62 having a substantially cylindrical tubular body 64 positioned inside of the outlet tube 12, a coupling nut 16 used to attach the vacuum breaker assembly 10 to a lower section 18 of a flush valve 20 (partially shown) and a shield 40 attached to a lower end of the coupling nut 16. The vacuum breaker 62 may be made of a unitary piece of elastomeric material or any other suitable material. Preferably, the vacuum breaker 62 is made of silicone. For example, the use of silicone allows vacuum breaker 62 to function properly without deterioration for approximately ten weeks in a concentrated chloramine bath. Additionally, the silicone allows for more consistent performance over a greater temperature range than other elastomeric materials.

Figure 6:
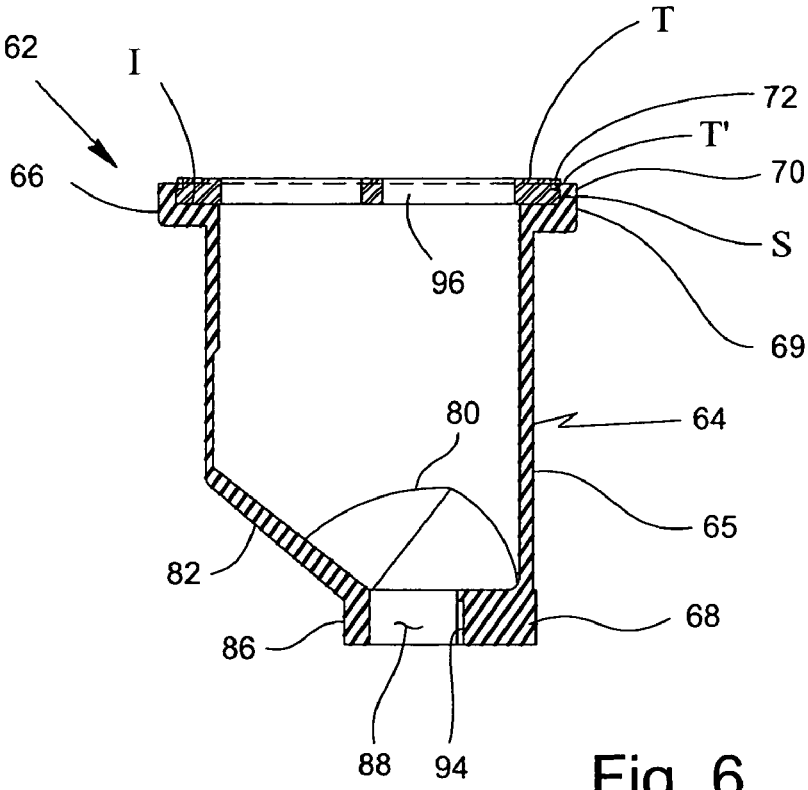
FIG. 6 is a cross-section view of the vacuum breaker shown in FIG. 5 taken along lines VI-VI.
Figure 7A:
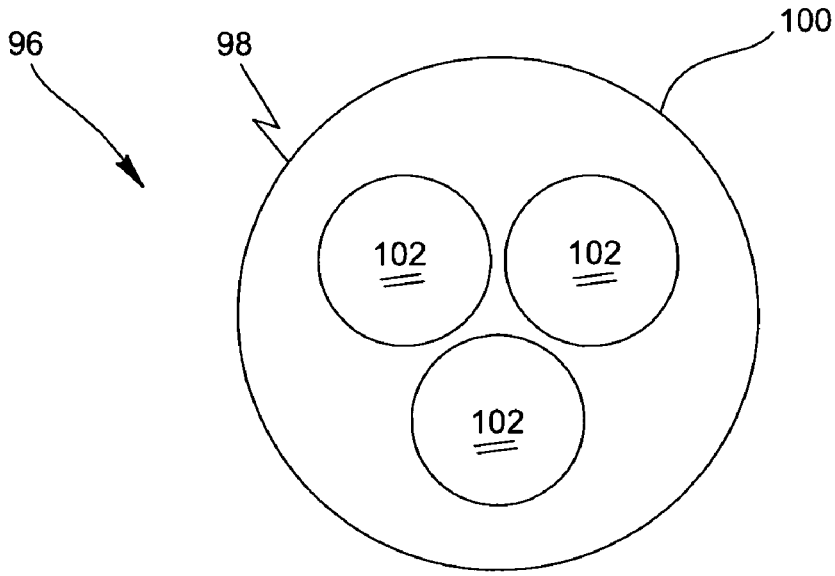
FIG. 7A is a top plan view of a first embodiment of an insert for use with the vacuum breaker assembly shown in FIG. 3.
Figure 8A:
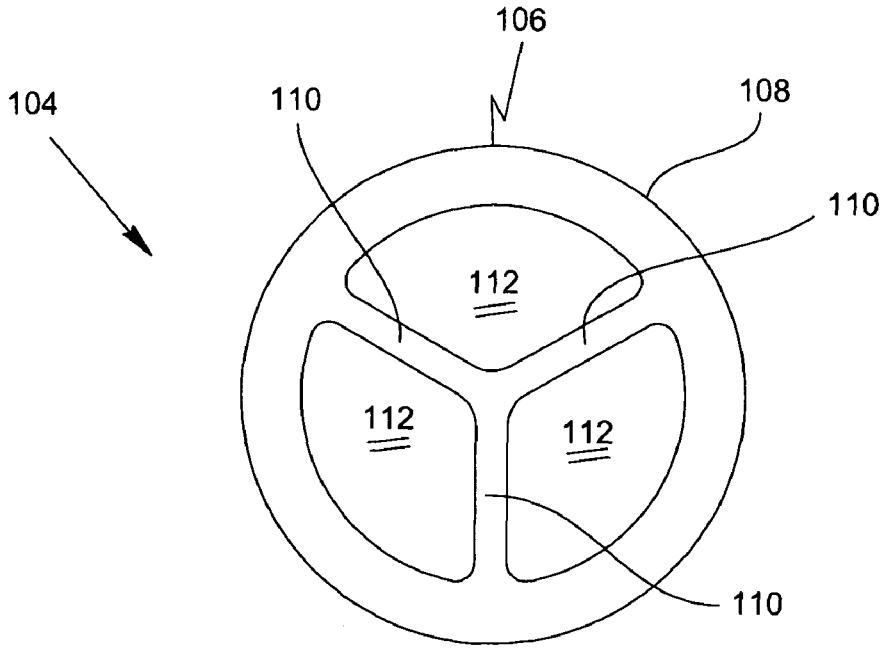
FIG. 8A is a top plan view of a second embodiment of an insert for use with the vacuum breaker assembly shown in FIG. 3.

Referring to FIGS. 3-6, the body 64 of the vacuum breaker 62 defined by a side wall 65 includes an inlet or first end 66 and an outlet or second end 68. The first end 66 includes an annular rim 69 extending away from the side wall 65 and a step or ledge 70 axially extending away from the rim 69 thus defining an L-shaped profile. The first end 66 of the vacuum breaker 62 is adapted to releasably seat a flow control insert or baffle arrangement on an inner surface I of the rim 69 and an inner surface S of the ledge 70. The flow control insert or baffle arrangement is a flat, slotted flow control insert 96 or 104 such as shown in FIGS. 7A and 8A, respectively, which will be discussed later. Referring to FIG. 3, the first end 66 of the vacuum breaker 62 also includes an integral lip or retainer bead 72 extending slightly away from the ledge 70 toward the side wall 65, wherein the retainer bead 72 provides for a friction fit between the flow control insert 96 or baffle arrangement and the ledge 70 on the first end 66 of the vacuum breaker 62. The retainer bead 72 shown in FIGS. 3 and 6 is in exaggerated form, and in normal operation a peripheral edge 100 of the flow control insert 96 or baffle arrangement would squeeze the bead 72 flush against the inner surface S of the ledge 70 thus providing a quick snap-in fit or friction fit, thereby releasably attaching the flow control insert 96 or baffle arrangement to the first end 66 of the vacuum breaker 62. When the insert 96 is in place, retainer bead 72 does not extend over or cover a portion of a top surface T of the insert 96 thus maintaining a flat surface. Preferably, the top surface T of the flow control insert 96 extends slightly above a top surface T' of the ledge 70 as shown in phantom in FIG. 6. Referring to FIG. 3, once the vacuum breaker 62 is assembled and placed within the outlet tube 12 and the coupling nut 16 is tightened, the lower section 18 first contacts the top surface T of the flow control insert 96. Continued tightening of the coupling nut 16 compresses the rim 69 until the top surfaces T, T' are flush as shown in FIG. 3. This arrangement prevents tearing and buckling of the vacuum breaker 62 during installation. The retainer bead 72 thickness is several thousandth of an inch and is relatively small compared to the flow control insert 96 which can have a thickness of one or more inches. Hence, for all intents and purposes, the insert 96, which is typically made of a harder less flexible material than the vacuum breaker 62, compresses the retainer bead 72 to be substantially flush with the inner surface S of the ledge 70. FIGS. 3 and 6 show the profile of retainer bead 72 extending beyond the inner surface S of the ledge 70 for illustrative purposes only. This simple two-piece design allows for faster and easier installation and offers improved sealing.

Figure 4A:
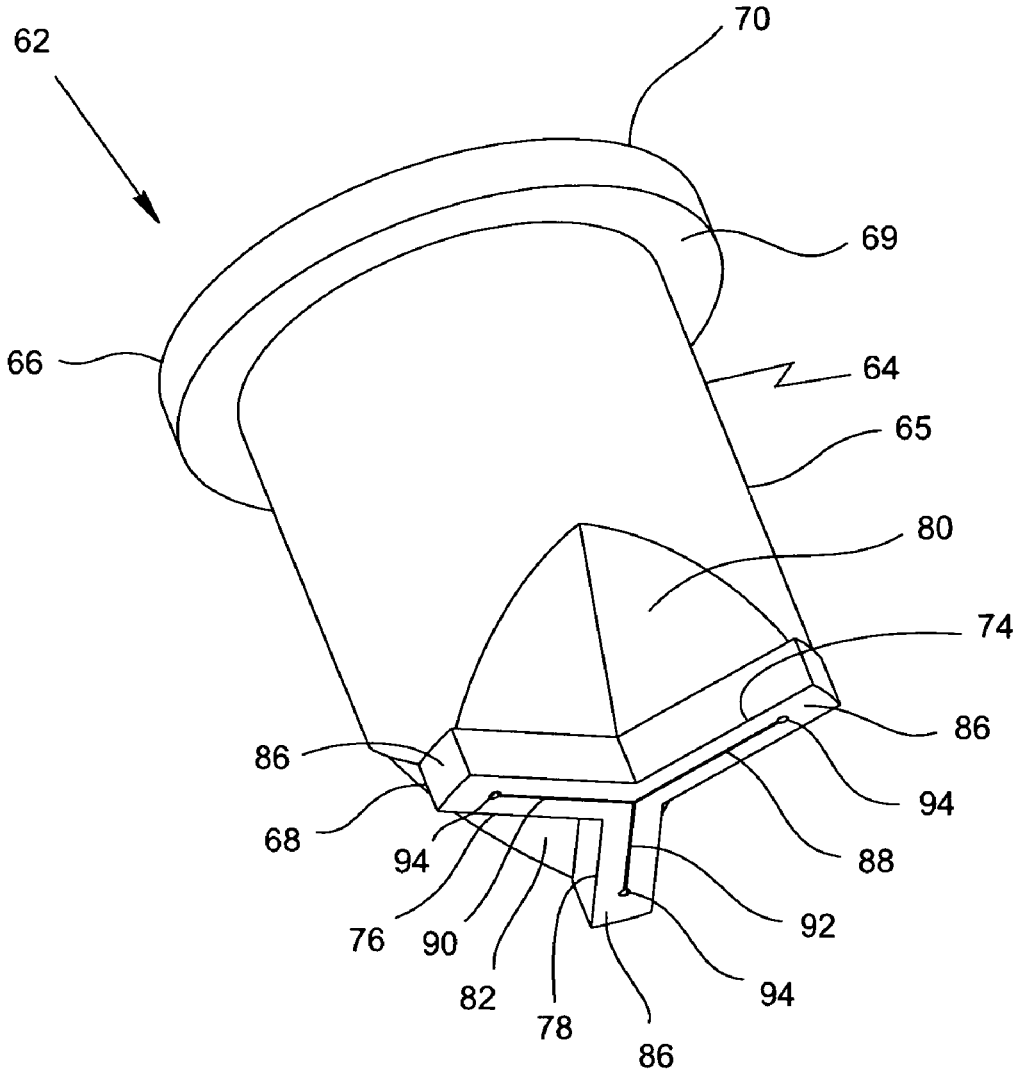
FIG. 4A is a bottom perspective view of a vacuum breaker of the vacuum breaker assembly shown in FIG. 3.
Figure 4B:
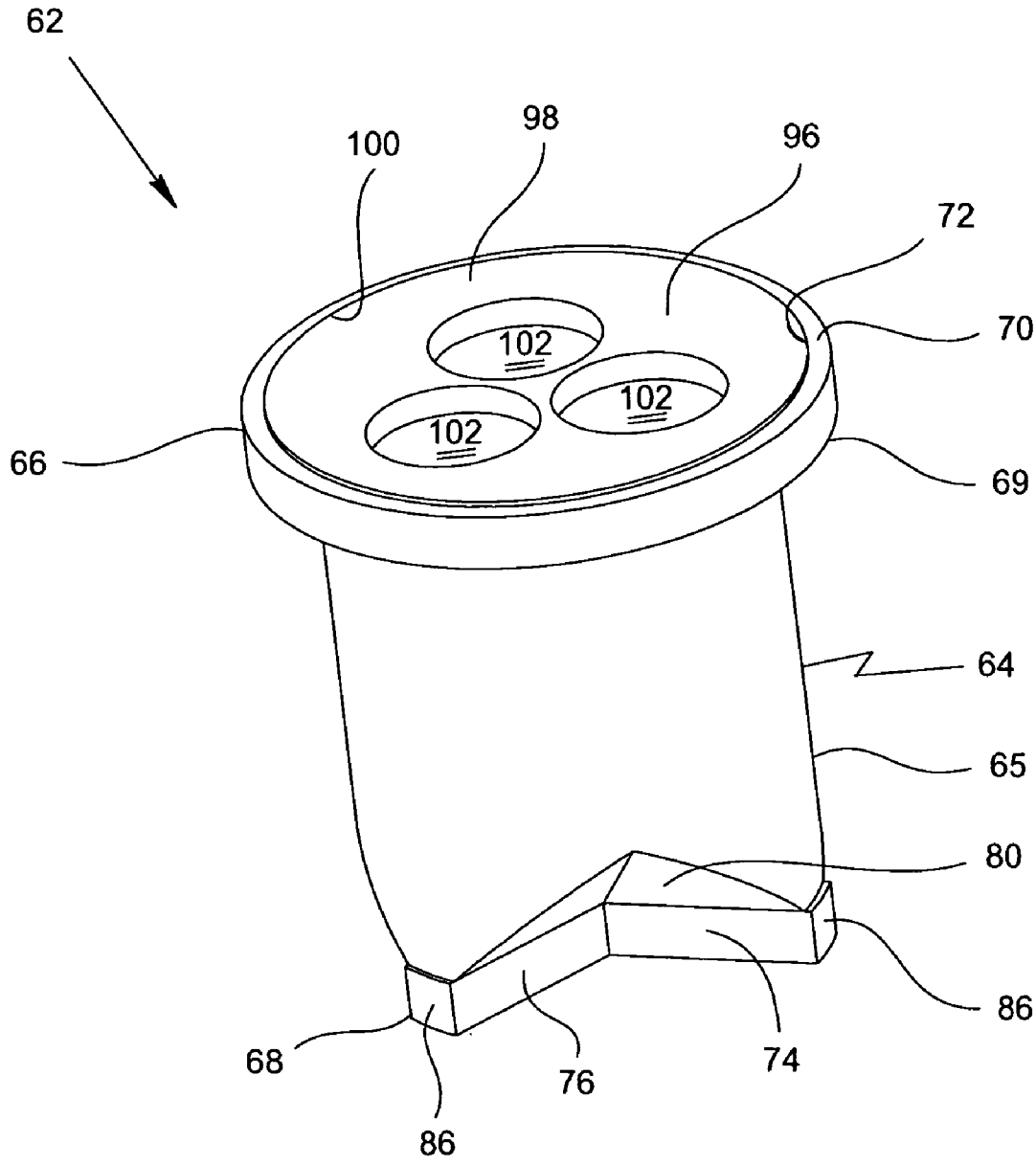
FIG. 4B is a top perspective view of the vacuum breaker shown in FIG. 4A.
Figure 5:
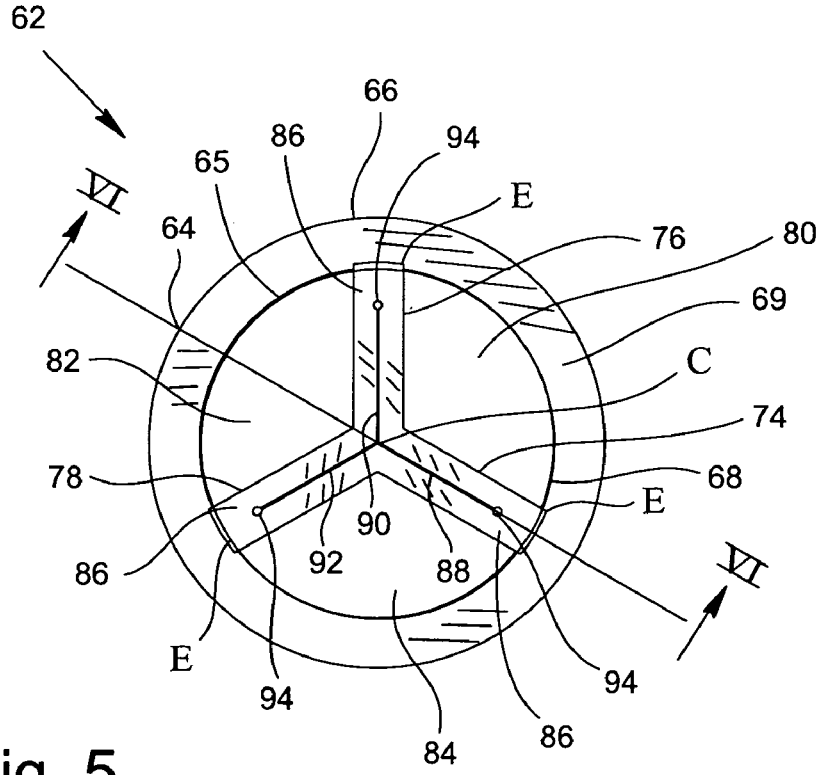
FIG. 5 is a bottom plan view of the vacuum breaker shown in FIG. 4A.

Referring to FIGS. 4A, 4B and 5, the vacuum breaker 62 includes a plurality of lip seals 74, 76 and 78 at the outlet or second end 68 thereof. The side wall 65 of the body 64 of the vacuum breaker 62 merges with a plurality of inwardly tapered wall sections 80, 82 and 84 that extend toward an axial center C at the second end 68 and merge with a plurality of circumferentially-spaced projections or ribs 86 thus forming lip seals 74, 76 and 78. Each lip seal 74, 76 and 78 has a slit 88, 90 and 92, respectively, defined between each respective rib 86, wherein the slits 88, 90 and 92 extend from the axial center C outward to a point adjacent an outer end E of the ribs 86 as shown in FIG. 5. The slits 88, 90 and 92 are adapted to open to permit the passage of water through the vacuum breaker assembly 60. The vacuum breaker 62 is similar to the prior art vacuum breaker 22 and operates in a similar manner, except that each of the cut slits 88, 90 and 92 includes a molded hinged member 94 adjacent the outer end E thereof. Hinged member 94 may be in the shape of a small hole which prevents each of the slits 88, 90 and 92 from tearing and to maintain the correct slit length. This reduction in the tearing of the vacuum breaker 62 increases durability and enhances performance. Preferably, during manufacturing of the vacuum breaker 62, the body 64 is molded with the hinged members 94 or holes without any slits. The slits are cut from the axial center C to the respective hole. This ensures that the slits are all the same length. Further, the holes act as stress relief to prevent further propagation of the slits during operation (i.e., flexing) of the vacuum breaker 62, so that the slits maintain their original length during operation.

Figure 7B:
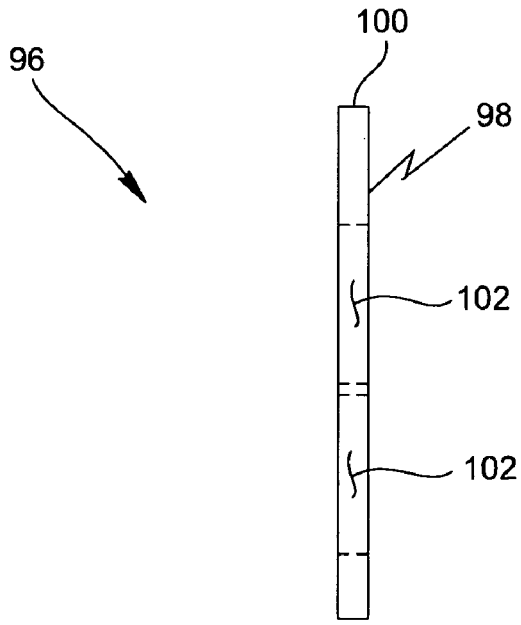
FIG. 7B is a side elevational view of the insert shown in FIG. 7A.
Figure 8B:
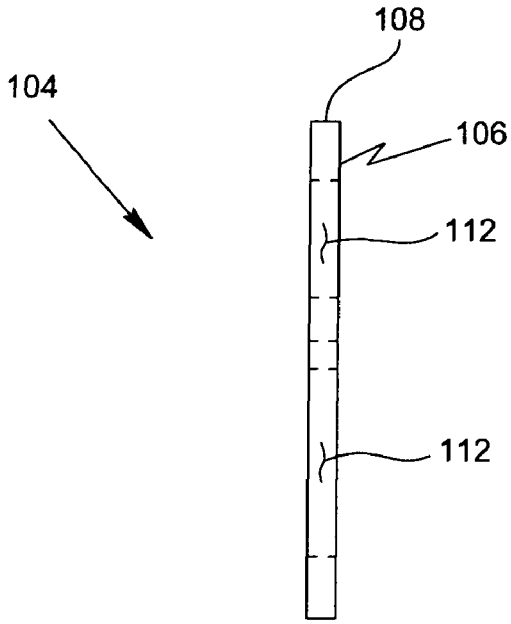
FIG. 8B is a side elevational view of the insert shown in FIG. 8A.

FIGS. 7A, 7B, 8A and 8B show two different embodiments of a flat, slotted flow control insert. FIGS. 7A and 7B show a first embodiment of a flow control insert 96 that includes a flat, disc-shaped body 98 having a peripheral edge 100 and defining a plurality of circumferentially-spaced circular opening or holes 102 therein. FIGS. 8A and 8B show a second embodiment of a flow control insert 104 that includes a flat body 106 having a peripheral edge 108 and defining a plurality of circumferentially-spaced spokes 110 forming pie-shaped openings or holes 112 therein. The holes 102, 112 in each insert 96, 104 are larger than the openings in the prior art insert, thereby allowing water to pass therethrough with less pressure drop. When the flow control inserts 96, 104 are seated on the rim 69 on the first end 66 of the vacuum breaker 62, a top surface of the ledge 70 is lower than a top surface of the flow control inserts 96, 104 thus eliminating the need for a paper gasket seal 38 to form a friction surface between the prior art vacuum breaker 22 and the lower section 18 of the flush valve 20, via the coupling nut 16. Further, the use of thicker and larger diameter flat flow control inserts 96, 104 leads to a reduced pressure drop during use and resists buckling and stoppage of valve internals in contrast to the prior art cone-shaped inserts of comparable thicknesses and diameters. The flow control inserts 96, 104 may be constructed from either an elastomeric or polymeric material. However, flow control inserts 96, 104 are preferably made from a different material than the vacuum breaker 62.

The present invention provides for a method of assembling a vacuum breaker assembly 60 for use with a flush valve assembly. The method includes the steps of providing an outlet tube 12 having circumferentially-spaced air openings 14 therein and installing a vacuum breaker 62 having a substantially cylindrical tubular body 64 inside of the outlet tube 12. A flow control insert 96 or 104 is releasably seated on the inner surface I of the rim 69 between the inner surface S of the ledge 70 on the first end 66 of the vacuum breaker body 64, thereby releasably attaching the flow control insert 96 or 104 to the vacuum breaker 62, via the retainer bead 72. Finally, the first end 66 of the vacuum breaker 62 along with an end of the outlet tube 12 is attached to a lower section 18 of a flush valve 20 via a coupling nut 16.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A vacuum breaker for use with a flush valve assembly, the vacuum breaker comprising:

a flow control insert;

a substantially cylindrical tubular body having a first end and a second end, the first end having a rim extending away from the body and a ledge extending axially away from the rim, each of said rim and said ledge having an inner surface, wherein the rim and ledge define an L-shaped profile wherein the flow control insert is releasably seated adjacent to said inner surface of said rim and said inner surface of said ledge, said ledge having a top surface located one of substantially within or slightly below the plane of a top surface of the flow control insert such that the top surface edge portions of the flow control insert are exposed;

a retainer bead positioned at the first end of said body and extending axially away from said inner surface of said ledge, wherein an inner circumferential surface of said retainer bead contacts an outer peripheral edge of said flow control insert, whereby the peripheral edge is defined as an edge surface bridging a top and bottom circumferential surface of said flow control insert, thereby providing a friction fit between the flow control insert and the ledge, whereby the peripheral edge of the flow control insert squeezes said retainer bead flush against the inner surface of the ledge, and a planar top surface of said flow control insert extends above a top surface of said retainer bead, whereby said flow control insert is releasably attached to said body; and a plurality of lip seals positioned at the second end of the body, wherein each lip seal defines a slit therein for allowing the passage of water through the vacuum breaker.

2. The vacuum breaker as claimed in claim 1, wherein each slit comprises a hinged member at an end thereof.

3. The vacuum breaker as claimed in claim 2, wherein the hinged member is in the shape of a hole.

4. The vacuum breaker as claimed in claim 1, wherein the body is made of a unitary piece of material.

5. The vacuum breaker as claimed in claim 4, wherein the body comprises an elastomeric material.

6. The vacuum breaker as claimed in claim 4, wherein the body comprises silicone.

7. The vacuum breaker as claimed in claim 1, wherein the retainer bead is integrally attached to the inner surface of the ledge of the body of the vacuum breaker.

8. The vacuum breaker as claimed in claim 1, wherein the flow control insert comprises a substantially flat disc-shaped body defining a peripheral edge, the disc-shaped body defining a plurality of circumferentially-spaced openings therein for allowing the water to flow therethrough.

9. The vacuum breaker as claimed in claim 8, wherein the plurality of openings in the flow control insert are circular, pie-shaped or any combination thereof.

10. The vacuum breaker as claimed in claim 1, wherein the flow control insert comprises a polymeric material.

11. The vacuum breaker as claimed in claim 1, wherein the flow control insert is constructed from a different material than the body of the vacuum breaker.

12. A vacuum breaker assembly comprising:

an outlet tube having circumferentially-spaced air openings therein;

a vacuum breaker having a substantially cylindrical tubular body positioned inside the outlet tube, the vacuum breaker body having a first end and a second end, the first end having a rim extending away from the body and a ledge extending axially away from the rim said ledge having a top surface, wherein the rim and ledge define an L-shaped profile adapted to receive a flow control insert, the second end of the body having a plurality of lip seals, wherein each lip seal defines a slit therein;

a flow control insert having a body and a top surface and defining a plurality of circumferentially-spaced openings therein, the insert releasably seated on the rim of the vacuum breaker body such that the top surface of the flow control insert is within the same plane or slightly above the plane of the top surface of the ledge such that the top surface edge portions of the flow control insert are exposed, wherein the first end of the vacuum breaker is adapted to attach to a flush valve; and a retainer bead positioned at the first end of said body and extending axially away from an inner surface of said ledge, wherein an inner circumferential surface of said retainer bead contacts an outer peripheral edge of said flow control insert, whereby the peripheral edge is defined as an edge surface bridging a top and bottom circumferential surface of said flow control insert, thereby providing a friction fit between the flow control insert and the ledge whereby the peripheral edge of the flow control insert squeezes said retainer bead flush against the inner surface of the ledge, and a planar top surface of said flow control insert extends above a top surface of said retainer bead, whereby said flow control insert is releasably attached to said body.

13. The vacuum breaker assembly as claimed in claim 12, wherein the flow control insert comprises a substantially flat disc-shaped body defining a peripheral edge, wherein the plurality of openings in the flow control insert are circular, pie-shaped or any combination thereof.

14. The vacuum breaker assembly as claimed in claim 12, wherein the slit in each lip seal comprises a hinged member at an end thereof.

15. The vacuum breaker assembly as claimed in claim 14, wherein the hinged member is in the shape of a hole.

16. A method of assembling a vacuum breaker assembly for use in a flush valve assembly, the method comprising the steps of:

a) providing an outlet tube having circumferentially-spaced air openings therein;

b) installing a vacuum breaker having a substantially cylindrical tubular body inside the outlet tube, the vacuum breaker body having a first end and a second end, the first end having a rim extending away from the body and a ledge extending axially away from the rim, said ledge having a top surface and wherein the rim and ledge define an L-shaped profile, a retainer bead extending axially away from an inner surface of the ledge toward the vacuum breaker body, wherein the retainer bead is adapted to provide a friction fit for releasably attaching a flow control insert to the first end of the body of the vacuum breaker, the second end of the body having a plurality of lip seals, wherein each lip seal defines a slit therein;

c) placing said flow control insert having a substantially flat disc-shaped body on the rim between the inner surface of the ledge on the first end of the vacuum breaker body such that an inner circumferential surface of said retainer bead contacts an outer peripheral edge of said flow control insert, whereby the peripheral edge is defined as an edge surface bridging a top and bottom circumferential surface of said flow control insert, thereby providing a friction fit between the flow control insert and the ledge by squeezing said retainer bead flush against the ledge, thereby releasably attaching the flow control insert to the vacuum breaker, a planar top surface of said flow control insert extends above a top surface of said retainer bead, said top surface of the flow control insert being within the same plane or slightly above the plane of the top surface of the ledge so that the top surface edge portions of the flow control insert are exposed; and d) attaching the first end of the vacuum breaker along with an end of the outlet tube to a lower section of a flush valve.

17. The method as claimed in claim 16, wherein the slit in each lip seal comprises a hinged member at an end thereof.

* * * * *